US008586167B2

(12) United States Patent
Marcalus et al.

(10) Patent No.: US 8,586,167 B2
(45) Date of Patent: Nov. 19, 2013

(54) TRI-FOLD NAPKIN

(75) Inventors: Nicholas Marcalus, Sugar Loaf, PA (US); Alec Marcalus, Sugar Loaf, PA (US)

(73) Assignee: BelleMarque, LLC, West Hazelton, PA (US)

( * ) Notice: Subject to any disclaimer, the term of this patent is extended or adjusted under 35 U.S.C. 154(b) by 219 days.

(21) Appl. No.: 13/214,334

(22) Filed: Aug. 22, 2011

(65) Prior Publication Data

US 2013/0052428 A1 Feb. 28, 2013

(51) Int. Cl.
*B32B 3/04* (2006.01)

(52) U.S. Cl.
USPC ..... 428/126; 428/130

(58) Field of Classification Search
USPC ..... 428/126, 130; 221/48; 206/494
See application file for complete search history.

(56) References Cited

U.S. PATENT DOCUMENTS

| | | | | |
|---|---|---|---|---|
| 4,859,518 | A | 8/1989 | Schutz | |
| 5,118,554 | A | 6/1992 | Chan | |
| 5,356,032 | A | 10/1994 | Rhodes | |
| 5,368,188 | A | 11/1994 | Twardowski | |
| 5,565,258 | A | 10/1996 | McConnell | |
| 5,690,250 | A | 11/1997 | Gooding | |
| 5,853,845 | A | 12/1998 | McConnell | |
| 6,168,848 | B1 | 1/2001 | Heath | |
| 6,213,346 | B1 | 4/2001 | Skerrett | |
| 6,306,480 | B1 * | 10/2001 | Yardley et al. | 428/121 |
| 6,623,833 | B2 | 9/2003 | Chan | |
| 6,641,894 | B2 | 11/2003 | Bando | |
| 7,097,896 | B2 | 8/2006 | Merrill | |
| 7,611,765 | B2 | 11/2009 | Hochtritt | |
| 7,625,333 | B2 | 12/2009 | Yardley | |
| 7,670,669 | B2 | 3/2010 | Du Grosriez | |
| 7,939,159 | B2 | 5/2011 | Hochtritt | |
| 2005/0058807 | A1 * | 3/2005 | Hochtritt et al. | 428/126 |
| 2007/0205212 | A1 | 9/2007 | Klingel | |

* cited by examiner

*Primary Examiner* — Alexander Thomas
(74) *Attorney, Agent, or Firm* — Matt Rogers; Rosenn, Jenkins & Greenwald, LLP

(57) ABSTRACT

The present invention is a folded paper napkin that allows the owner of two (2) or more different types of napkin dispensers to refill those dispensers with the same napkin while still achieving a one-at-a-time rate of withdrawal. More particularly, the present invention is a paper napkin of specific dimensions that is comprised of two (2) folds along its unfolded length and interleaved with a similarly-dimensioned folded napkins.

5 Claims, 3 Drawing Sheets

TRI-FOLD NAPKIN

CROSS-REFERENCE TO RELATED APPLICATIONS

Not Applicable.

STATEMENT REGARDING FEDERALLY SPONSORED RESEARCH

Not Applicable.

BACKGROUND

1. Field of Invention

The present invention relates to paper napkins In particular, the present invention relates to folded paper napkins designed to be inserted in bulk and withdrawn one-at-a-time from a dispenser.

2. Description of Related Art

Folded paper napkins for use in napkin dispensers in food service establishments are well known. In the food service and restaurant industries, disposable napkins in dispensers are made available to patrons in a manner that is both sanitary and easy to use. Some folded napkin types and the dispensers designed for their use do not dispense consistently or easily one-at-a-time. An example of a folded napkin type which does not dispense easily or consistently one-at-a-time is referred to by the restaurant industry as a Tall-Fold Napkin. This type of folded dispenser napkin is exemplified by the Hyloap® Tall Fold Dispenser Napkin sold by Georgia Pacific Corp., Manufacturer Item Number 33201. It has folded dimensions of 3.5"×6.5" and unfolded dimensions of 7"×13.5". Typically, it is used by restaurants in a metal or plastic dispenser box which loads from both sides with a folded steel plate on either side of the napkins which acts as a spring to move the napkins to either the outer edge or each side of the dispenser as napkins are removed for use by the restaurant patron. Tall-Fold Napkins are folded but without each napkin in the napkin stack being interconnected (i.e., interleaved). Therefore, a common problem with dispensing this type of napkin is that a patron often pulls more than one napkin at-a-time from the dispenser because there is no protruding edge of the napkin lifted up after the patron removes a napkin from the dispenser. Restaurants that use Tall-Fold Napkins in Tall-Fold dispensers often experience a high rate of napkin waste as the patron will often grab more than one napkin when reaching into the dispenser to take a napkin because there is no leading edge of the napkin protruding.

Another goal of food service and restaurant establishments is to reduce the time necessary for staff to replace/refill napkins in dispensers. Tall-fold dispensers typically have a capacity for 150 paper napkins. This capacity, and the tendency of patrons to take more than one napkin when reaching into the dispenser, results in the need to frequently refill the dispenser. Accordingly, some known napkin dispensers and folded paper napkins compatible with these dispensers are designed to prevent a user from withdrawing more than one napkin at-a-time. These napkin dispensers and folded paper napkins designed for use in these dispensers prevent a user from withdrawing more than one napkin at-a-time because a protruding edge of the napkin is readily available to the user to pull the napkin from the dispenser and therefore limited the user from withdrawing more than his or her desired number of napkins, which reduces napkin waster. These napkins are typically interleaved (interfolded) so that pulling one napkin results in the next napkin being pulled into position for the user to take the next napkin. Furthermore, these types of napkins not only provide a solution of one-at-a-time napkin use, but napkin consumption by a restaurant establishment may be reduced by as much as 25% compared to the consumption of Tall-Fold Napkins The one-at-a-time dispensing also improves hygiene as, unlike Tall-Fold Napkins, one-at-a-time napkin dispensing with interleaved napkin stacks virtually eliminates the need to touch the dispenser in order to withdraw napkins Known napkin dispensers and the napkins designed for use in said dispensers are, for example, Tork® Xpressnap and also Georgia-Pacific EasyNap®. Both of these brands have their own proprietary dispensers for use with the respective napkin brand. Also the Venue Tabletop Dispensers Interfold (H4003TBK) is marketed by San Jamar and designed to work with a variety of one-at-a-time folded paper napkins, including Tork Xpressnap® and EasyNap®, Cascades® Serve one, and Bellemarque Just1™.

Other examples of a napkin type with compatible dispenser that is common in food service and restaurant establishments, commonly referred to as a Mini-Fold Napkin, that does not easily dispense one-at-a-time is the Georgia Pacific Mini-HiNap, Item #3700, Cascades North River ServeRite III, Item #2750, and Kimberly-Clark Scott Mini-Fold Item #98750. Also similar is the SCA Luxri 13, Item D820. These napkins products have a folded dimension of 6.5" to between 3.5" and 3.8". Their unfolded dimension is nominally 13"×12". These napkins are marketed to be dispensed from a Mini-Fold dispenser; examples are the Palmer Fixture Table-Top Mini-Fold Napkin Dispenser—Item P.E.O. N55B5—and also the Georgia Pacific Mini Mornap Napkin, #3700, Mini-Fold Open Face Model Napkin Dispenser, Item #51502. Tork (SCA) Luxri 13, #D820, is another napkin product intended for dispensing in Mini-Fold dispensers. Similar to the problem with Tall-Fold Napkins, Mini-Fold Napkins present no leading edge protruding from the dispenser enabling the user to reach easily for one napkin at-a-time. Mini-Fold Napkins are not interleaved in the stack. The lack of a leading protruding edge of the napkin from the Mini-Fold dispenser due to the lack of interleaving results in the potential for the user taking more than one napkin at-a-time and thereby causing excess consumption of napkins for the food service establishment or restaurant.

The problem inherent with Tall-Fold and Mini-Fold Napkin types and their respective dispensers is that in addition to the problems of excess napkin consumption previously described, neither napkin type is interchangeable outside of their respective dispenser types. Therefore, a Tall-Fold Napkin package does not fit or dispense easily from a Mini-Fold Dispenser and a Mini-Fold Napkin does not fit or dispense easily from a Tall-Fold Dispenser. This problem requires a food service establishment or restaurant that places either Tall-Fold Dispensers or Mini-Fold Dispensers in their establishment to use only the specific napkin type made for the particular dispenser.

There is accordingly a need for a folded paper napkin that achieves the easily-refillable characteristic in both Tall-Fold and Mini-Fold Dispensers, and also the characteristic of one-at-a-time dispensing.

SUMMARY

The present invention is a folded paper napkin that is cut and folded in such a way as to allow the napkin to be inserted into, and withdrawn in a one-at-a-time fashion from, a Tall-Fold and Mini-Fold Dispenser. When the user pulls a napkin of the present invention from either a Tall-Fold or Mini-Fold Dispenser, a protruding leading edge from the interleaved napkin is presented. As the edge is pulled by the user, another napkin, again with the leading edge protruding, is presented. Because certain embodiments of the invention is 6.43" wide and 10.875" long, with the length folded into ⅓ panels, the folded dimension is 6.43" by 3.625". The present invention allows a dispenser owner to purchase only one napkin to refill a Tall-Fold and/or Mini-Fold Dispenser because both types of dispensers are designed to be uses with napkins folded to a nominal dimension of the present invention's folded size. The present invention is directed to an approximately 10.875" long by 6.43" wide paper napkin in the unfolded dimensions that is folded twice along its length so that when folded, the napkin's length changes to a folded length of between 3.6" to 3.7".

DETAILED DESCRIPTION

Figure 1:
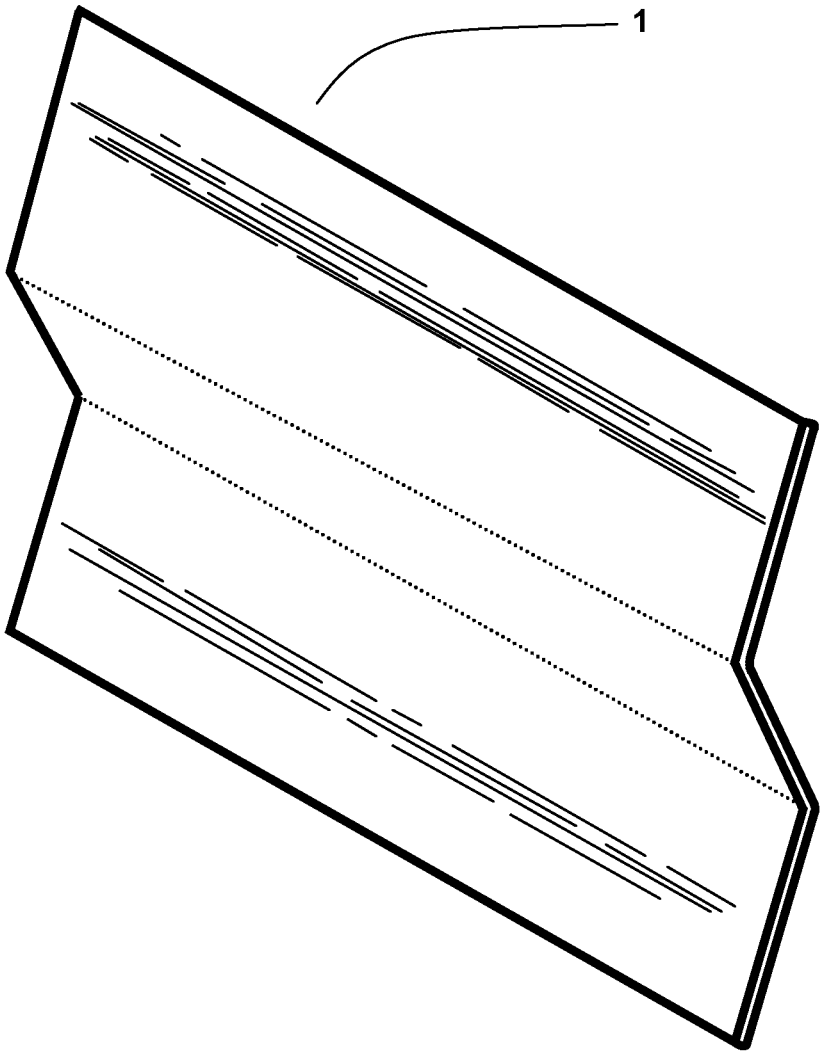
FIG. 1 is a perspective view of a folded paper napkin consistent with the present invention.

Napkins manufactured in accordance with the present invention can be manufactured out of any paper material or non-woven substrate. Techniques for strengthening and softening paper material or enhancing its appearance (e.g., application of embossing patterns) to achieve desired napkin texture and look are well known to skilled artisans, and any such techniques may be employed to manufacture napkins consistent with the present invention.

Napkins made in accordance with the present invention have an unfolded length-to-width ratio of less than 1.69 to 1. Together with the napkins' preferred dimensions discussed herein, the length/width ratio allows the present invention to load into a tall-fold dispenser or a mini-fold dispenser, which differentiates the present invention from known folded paper napkins such as the one disclosed in U.S. Pat. No. 6,306,480 to Yardley, et al., which discloses a folded paper napkin with length/width ratio of at least 1.7:1 and preferably between 2:1 to 3:1.

In preferred embodiments of the present invention, the napkins have an unfolded length of approximately 10", and preferably a unfolded length of 10.875". The napkins have a width of between 6.4" and 6.6", and preferably 6.437". The napkins are folded in two (2) places along their unfolded length. The napkins are folded in such as way as to produce a folded length of between 3.4" and 4", and preferably 3.625".

In preferred embodiments of the invention, the paper napkin 1 is folded as shown in FIG. 1.

Figure 2:
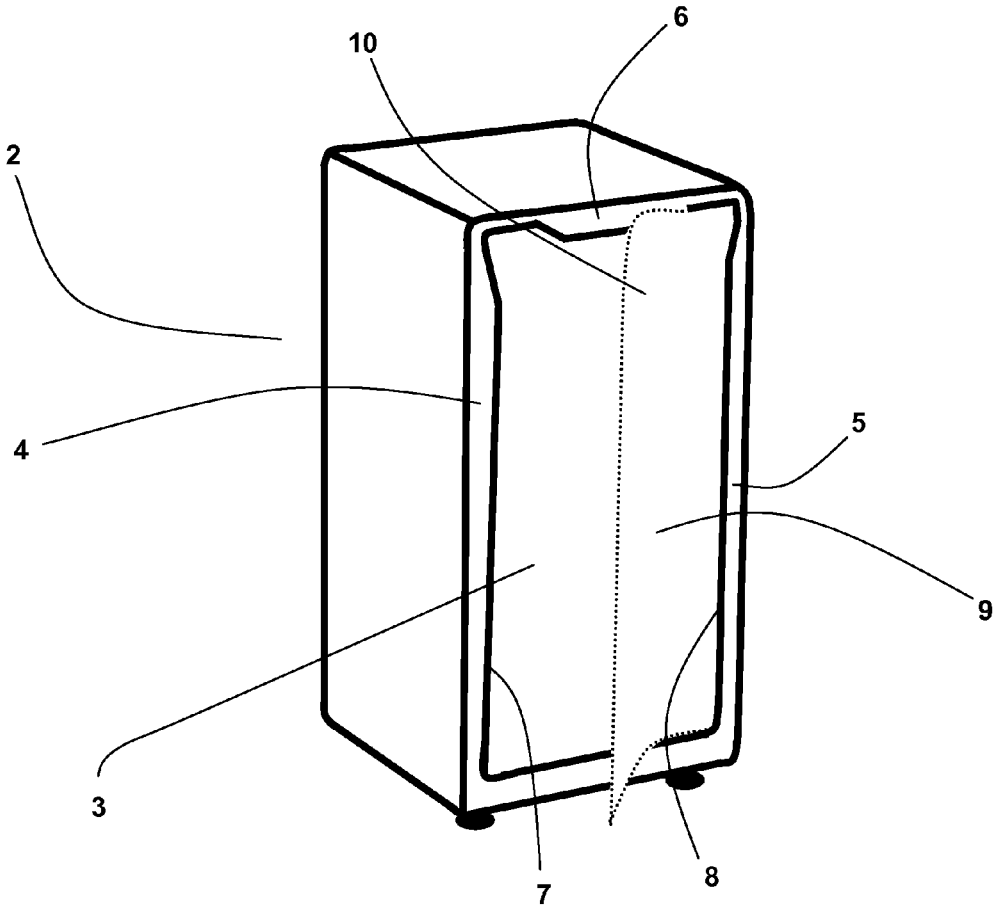
FIG. 2 is a perspective view of a standard tall-fold napkin dispenser dispensing a folded paper napkin consistent with the present invention.

A standard tall-fold napkin dispenser 2 is shown in FIG. 2. On either side of the tall2fold dispenser's 2 opening 3 are left 4 and right 5 lips that extend from the outer dimensions of the tall-fold dispenser 2 inward. The total width of the opening 3 is approximately 3.75" whereas the space between the inner edges 7, 8 of the left 4 and right 5 lips is approximately 3.4". The top lip 6 extends from the top of the opening 3 downward. The total height of the dispenser 2 is approximately 7" whereas the space between the top lip 6 and the bottom of the dispenser 2 is approximately 6.4". In order for the left 4, right 5, and top lips 6 to hold the paper napkins inside the dispenser 2, the paper napkins must have minimal dimensions of 6.4" by 3.4". However, to fit into the dispenser 2 without cramming, the dimensions of the paper napkins cannot exceed 7" by 3.75".

When a paper napkin 9 consistent with the present invention is loaded into the tall-fold napkin dispenser 2, its folded dimensions allow the napkin 9 to be loaded securely into the dispenser 2 so that the leading edge 10 of the top napkin 9 positioned against the lips 4, 5, 6 of the dispenser 2 can be threaded through the opening 3 as shown in FIG. 2. A user can then grab the leading edge 10 of the top napkin 9, pull the top napkin 9 through the opening 3, thereby pulling the leading edge 10 of the interleaved second napkin through the opening 3 to make it available for the user to get a second napkin or for the next user to pull. Each subsequent napkin may be pulled through the opening 3 in similar fashion. This allows the napkins to be easily dispensed one at a time.

Figure 3:
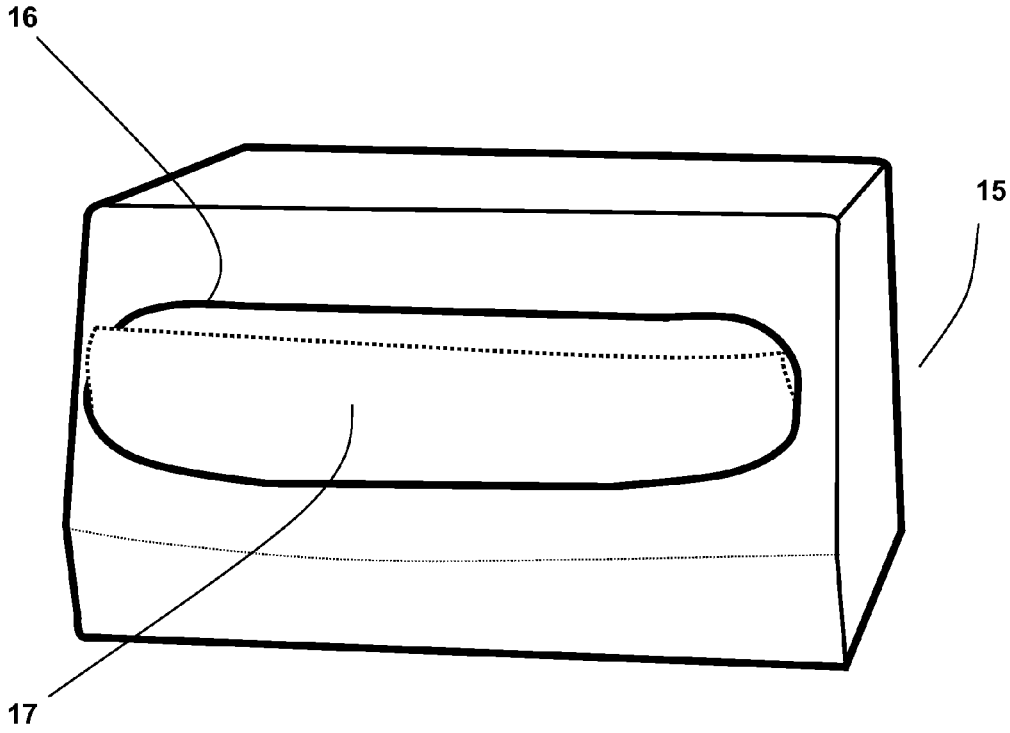
FIG. 3 is a perspective view of a standard mini-fold napkin dispenser dispensing a folded paper napkin consistent with the present invention.

FIG. 3 shows a standard minifold napkin dispenser 15. Similar to the countertop dispenser described immediately above, the minifold dispenser 15 is comprised of an opening 16 that is smaller than the interior dimensions of the dispenser 15 itself. Folded paper napkins 17 consistent with the present invention can likewise be loaded into a countertop dispenser and withdrawn one at a time.

What is claimed is:

1. A folded paper napkin comprising two (2) folds along the unfolded length of said napkin, wherein:

(a) the unfolded length of said napkin is between 10 inches and 12 inches;

(b) the folded length of said napkin is between 3.4 inches and 4 inches;

(c) the width of said napkin is between 6.4 inches and 6.6 inches; and (d) said napkin is interleaved with a second, similarly dimensioned folded paper napkin;

wherein said napkin's unfolded length-to-width ratio is less than 1.69:1.

2. The folded paper napkin of claim 1, wherein said unfolded length is 11 inches and said width is 6.5 inches.

3. The folded paper napkin of claim 1, wherein said unfolded length is 10.85 inches and said width is 6.437 inches.

4. The folded paper napkin of claim 3, wherein said folded length of said napkin is 3.625 inches.

5. The folded paper napkin of claim 1, wherein said folded length of said napkin is 3.625 inches.

* * * * *